US007340868B2

(12) United States Patent
Weber

(10) Patent No.: US 7,340,868 B2
(45) **Date of Patent: *Mar. 11, 2008**

(54) UNIVERSAL STRUCTURAL ELEMENT

(76) Inventor: Ralf D. Weber, 23630 Larkins Rd., Newberg, OR (US) 97132

( * ) Notice: Subject to any disclaimer, the term of this patent is extended or adjusted under 35 U.S.C. 154(b) by 197 days.

This patent is subject to a terminal disclaimer.

(21) Appl. No.: 10/927,923

(22) Filed: Aug. 28, 2004

(65) Prior Publication Data

US 2005/0034413 A1 Feb. 17, 2005

Related U.S. Application Data

(63) Continuation of application No. 10/149,548, filed as application No. PCT/DE00/00807 on Mar. 10, 2000, now Pat. No. 6,874,291.

(51) Int. Cl.
*E04B 2/00* (2006.01)

(52) U.S. Cl. ..... 52/586.1; 52/582.1; 52/586.2; 403/363; 446/85; 446/105; 446/118; 446/119; 446/124

(58) Field of Classification Search ..... 52/586.1, 52/656.9, 582.1, 586.2, 583.1, 578, 585.1; 403/403, 292, 294–295, 363; 446/1, 69, 446/85, 87, 104–128
See application file for complete search history.

(56) References Cited

U.S. PATENT DOCUMENTS

| | | | | | |
|---|---|---|---|---|---|
| 570,688 | A | * | 11/1896 | Stratton | 446/124 |
| 669,029 | A | | 2/1901 | Faller | |
| 712,839 | A | | 11/1902 | McGowan | |
| 1,009,469 | A | | 11/1911 | Burrowes | |
| 1,174,558 | A | * | 3/1916 | Friedel | 446/109 |
| 1,191,884 | A | * | 7/1916 | Finch | 446/122 |
| 1,286,462 | A | | 12/1918 | Wesche | |
| 1,668,551 | A | | 5/1928 | Crosman | |
| 2,020,562 | A | * | 11/1935 | Miller | 446/127 |
| 2,099,075 | A | | 11/1937 | Paulson | |
| 2,107,691 | A | | 2/1938 | Corser | |
| 2,143,667 | A | | 1/1939 | Troiel | |
| 2,225,612 | A | | 12/1940 | Allen | |
| 2,493,435 | A | | 1/1950 | Archabult | |

(Continued)

FOREIGN PATENT DOCUMENTS

DE 195 29 929 A1 2/1997

(Continued)

*Primary Examiner*—Jeanette Chapman
(74) *Attorney, Agent, or Firm*—Law Office of Karen Dana Oster, LLC

(57) ABSTRACT

The invention describes a universal structural element (1) for the purpose of forming in particular, three-dimensional structures, which structural element can be manufactured in a convenient manner efficiently, cost-effectively from the most varied materials and can be recycled in an environmentally-friendly manner, can be used and applied universally, enables a monolithic type of construction using similar connectors (5) for connecting similar structural elements together and with other elements at low assembly cost and allows disassembly or reconstruction work to be conducted in a straightforward and non-destructive manner, meets high static requirements and can preferably be standardized in modular dimensions. In accordance with the invention, a universal structural element (1) in the form of a profile body, having preferably a substantially square cross-section, comprises on all longitudinal sides undercut grooves (2) that are connected on the end sides (3) by means of intersecting undercut grooves (4) with preferably the same cross-section.

20 Claims, 7 Drawing Sheets

U.S. PATENT DOCUMENTS

| | | | | | |
|---|---|---|---|---|---|
| 2,810,233 | A | * | 10/1957 | Jakobsen | 446/126 |
| 2,972,233 | A | * | 2/1961 | Askevold | 405/27 |
| 3,005,282 | A | * | 10/1961 | Christiansen | 446/128 |
| 3,034,254 | A | * | 5/1962 | Christiansen | 446/128 |
| 3,456,413 | A | * | 7/1969 | Fischer | 52/591.1 |
| 3,516,194 | A | * | 6/1970 | Schmidlin | 446/86 |
| 3,563,582 | A | | 2/1971 | Shroyer et al. | |
| 3,604,146 | A | | 9/1971 | Winer | |
| 3,640,039 | A | | 2/1972 | McKee et al. | |
| 3,676,969 | A | * | 7/1972 | Moore | 52/233 |
| 3,699,709 | A | * | 10/1972 | Schmidt | 446/113 |
| 3,716,939 | A | * | 2/1973 | Pibet | 446/128 |
| 3,800,494 | A | * | 4/1974 | Hall et al. | 403/331 |
| 3,803,754 | A | * | 4/1974 | Fischer | 446/121 |
| 3,987,579 | A | * | 10/1976 | Palenik, III | 446/118 |
| 4,035,977 | A | | 7/1977 | Fischer | |
| 4,052,832 | A | | 10/1977 | Jungers et al. | |
| 4,143,481 | A | * | 3/1979 | Loechel | 446/122 |
| 4,317,306 | A | * | 3/1982 | Hotti | 446/126 |
| 4,367,871 | A | | 1/1983 | Schiefer | |
| 4,372,076 | A | * | 2/1983 | Beck | 446/106 |
| 4,441,293 | A | | 4/1984 | McQueen et al. | |
| 4,676,762 | A | | 6/1987 | Ballard | |
| 4,833,856 | A | | 5/1989 | Zwagerman | |
| 5,090,835 | A | | 2/1992 | Cox | |
| 5,730,544 | A | | 3/1998 | Dils et al. | |
| 5,938,497 | A | | 8/1999 | Mott | |
| 5,957,744 | A | | 9/1999 | Mott et al. | |
| 6,450,853 | B1 | | 9/2002 | Larws | |

FOREIGN PATENT DOCUMENTS

| | | |
|---|---|---|
| DE | 195 46 261 A1 | 6/1997 |
| EP | 0 306 111 A1 | 3/1989 |
| WO | WO 93/23631 | 11/1993 |

* cited by examiner

UNIVERSAL STRUCTURAL ELEMENT

The present application is a continuation of U.S. patent application Ser. No. 10/149,548, filed Nov. 5, 2002 (now U.S. Pat. No. 6,874,291). U.S. patent application Ser. No. 10/149,548 is a 35 US Section 371 of PCT of PCT/DE00/00807 filed Mar. 10, 2000 which claims priority to German patent application number 299 20 656.4, filed Nov. 24, 1999. The present application is based on and claims priority from U.S. patent application Ser. No 10/149,548, the disclosure of which is hereby expressly incorporated herein by reference in its entirety.

BACKGROUND OF INVENTION

The invention relates to a universal structural element, preferably in the form of a profile body having undercut grooves for the purpose of assembling identical universal structural elements together and other elements having undercut grooves with an identical or similar cross-section for the purpose of forming, in particular, three-dimensional structures.

The prior art discloses a plurality of solutions for combining profiles together by means of suitable connectors to form two-dimensional and also three-dimensional structures. Document DE 195 29 929 A1 discloses a method and construction kit for the purpose of producing structural body parts and complete construction bodies using structural elements, which are to be connected together, and an arrangement for connecting the structural elements, wherein the construction kit for the purpose of forming the two-dimensional or three-dimensional structures comprises the most varied structural elements which are designed specifically for each construction. The large number of different structural elements, in particular also for the purpose of forming three-dimensional structures, necessitates a large production range including correspondingly high storage costs, moreover the production of angular elements and further special connectors by means of welding from profiles or injection-molding processes is equally as costly as the framework-assembly of a structure consisting of the individual structural elements. Modifications to the arrangement of the elements for reconstruction works and the disassembly for re-usage purposes are not possible or are extremely costly.

Using this construction kit it is not possible to meet high static requirements. The assembly of building panels comprising undercut channels at their ends, into which a connector is introduced for the purpose of loosely connecting the panels and subsequently elastic inserts are driven into the intermediate spaces for reinforcement purposes, is described in document U.S. Pat. No. 3,640,039. The channels have a T-shaped cross-section and the panels are connected by double-T-shaped connectors. In order to connect transverse wall panels, specially designed connectors are required, as is the case for corner connections. It is only possible to connect transverse wall panels outside panel butts in the case of panels having additional lateral channels at sites that are predetermined during manufacture thereof.

The disadvantage of the solution resides in particular in the storage of the required larger number of different specific connectors for the panels, the connection of transverse walls, the corner formations and the wall panels which vary depending upon the installation site, and the high assembly outlay arising from the need to drive in the elastic inserts, wherein straightforward disassembly of or subsequent modifications to the arrangement of the panels cannot be made.

It is likewise not possible using the same connector system to connect lower upper ends in a convenient manner to a structure assembled in this way and consisting of wall panels.

Document EP-A-0 306 111 discloses an angular connector which is composed of 3 basic elements. By means of this connector as a joint connector, it is possible to connect up to 6 profiles together at an angle of 90 or 180°. In dependence upon the number and the desired connection angle, a different number of the various elements is required, thus resulting in costly storage for the individual elements of the angle connector that can be assembled.

BRIEF SUMMARY OF THE INVENTION

It is the object of the invention to develop a universal structural element for the purpose of forming, in particular, three-dimensional structures, which structural element can be manufactured in an efficient, cost-effective manner from the most varied materials, can be recycled in an environmentally-friendly manner, can be used and applied universally, enables a monolithic type of construction using similar connectors for connecting similar structural elements together and with other elements at low assembly cost and allows disassembly or reconstruction work to be conducted in a straightforward and non-destructive manner, meets high static requirements and can preferably be standardized in modular dimensions.

The object is achieved by the features stated in patent claim 1. Preferred developments are provided in the subordinate claims. The invention resides in the formation of a universal structural element in the form of a profile body having preferably a substantially square cross-section that on all longitudinal sides comprises undercut grooves that are connected on the end sides by means of intersecting, undercut grooves having preferably the same cross-section.

For specific applications, the undercut grooves in the longitudinal sides and also in those in the end sides can comprise different cross-sections.

The universal structural element can be produced from virtually all synthetic or natural materials, wherein materials that are suitable for continuous manufacture are preferable used for extrusion or extrusion-molding processes.

It is also within the scope of the invention optionally to arrange reinforcements in the profile cross-section.

In order to connect the universal structural element together [sic] in a non-positive or positive manner to form two-dimensional and/or three-dimensional structures, it is possible to introduce, into the grooves, profiles as connectors over the entire length of the universal structural element, of which the cross-section corresponds, in particular, to double the cross-section of the undercut groove as reflected at the longitudinal axis. If different profiles having undercut grooves of a different cross-section are connected together, then the formation of the profile of the connectors corresponds to the combination of the cross-sections thereof.

It is possible to perform a continuous assembly process when connecting several universal structural elements by way of the undercut grooves in the end sides thereof by means of connectors.

For the purpose of straightforward positive connections, it is also feasible to use flat profiles as connectors.

It is possible to tailor the selection of the material of the connectors to suit the respective application and to meet the requirements placed upon the structure produced from universal structural elements. For structures, upon which static requirements are placed, such as e.g. Ceilings as supporting construction parts, it is possible in particular to use steel connectors. For different applications, these connectors can consist of the most varied natural and/or synthetic materials. The cross-section of the undercut grooves of the universal structural element is preferably T-shaped, but can also be e.g. Wedge-shaped, circular or semi-circular with a cross-piece.

The undercut grooves can optionally be provided in the end sides of the universal structural element only as far as the depth of the longitudinal groove.

Furthermore, it is possible to form a universal structural element as a block which has a substantially rectangular cross-section and which along the narrow sides comprises undercut grooves which are connected on the end sides to undercut grooves, wherein the substantially rectangular cross-section corresponds to an integer multiple of the cross-section of the universal structural element having a substantially square cross-section.

The universal structural elements are preferably produced in lengths in a modular dimension for a modular construction system, so that construction orifices can be produced in a standardized size, into which frames of closure parts, which comprise grooves or undercut grooves, for construction orifices such as windows or doors can be inserted and said frames can be connected in a non-positive and positive manner to the universal structural elements by means of profiles.

Furthermore, it is possible to produce specific surface structures and/or coatings for the universal structural element that are inter alias decorative and/or functional.

The advantages of the invention reside particularly in the universal applicability of the universal structural element that can be produced from natural or synthetic materials. The universal structural element is environmentally-friendly and can be recycled. In dependence upon the cross-sectional size, the material used for the purpose of producing the universal structural element, the reinforcement provided and the specific properties of the connectors used, it is possible in a straightforward and rapid assembly process to produce, in a monolithic type of construction, constructions which meet static requirements, sealed containers, furniture or frames for receiving two-dimensional bodies, wherein the structures produced can be adapted conveniently to suit modified requirements and can then be disassembled in a problem-free manner. In addition to these areas of usage stated by way of example, it is also possible to use the said structural element in the area of model making and toys.

The similarity of the universal structural elements which are to be connected together permits an efficient manufacturing process with minimal storage of universal structural elements, which are produced in modular dimensions, and the associated connectors, wherein the universal structural elements can conveniently be combined together in a variable manner and with different or similar structural elements.

BRIEF DESCRIPTION OF THE SEVERAL VIEWS OF THE DRAWINGS

The invention is explained in detail as an exemplified embodiment with reference to the drawings.

DETAILED DESCRIPTION OF THE INVENTION

Figure 1:
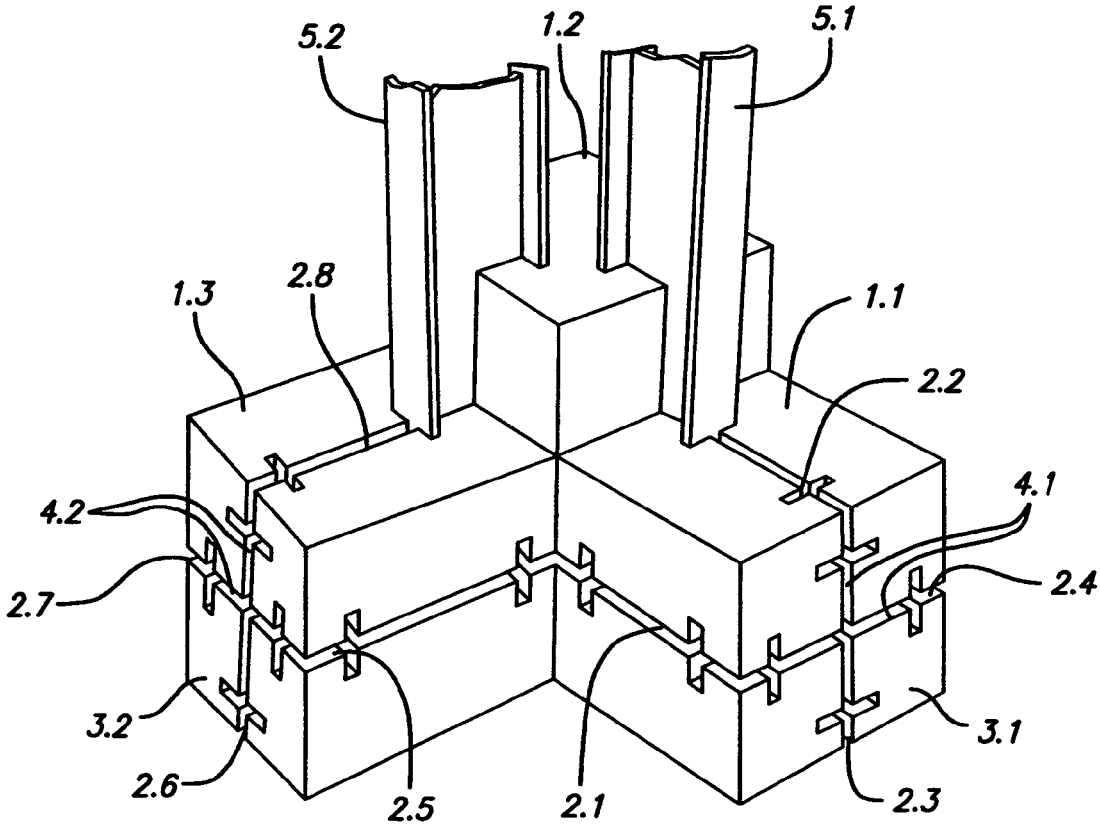
FIG. 1 shows an illustration of a corner formation with universal structural elements.
Figure 2:
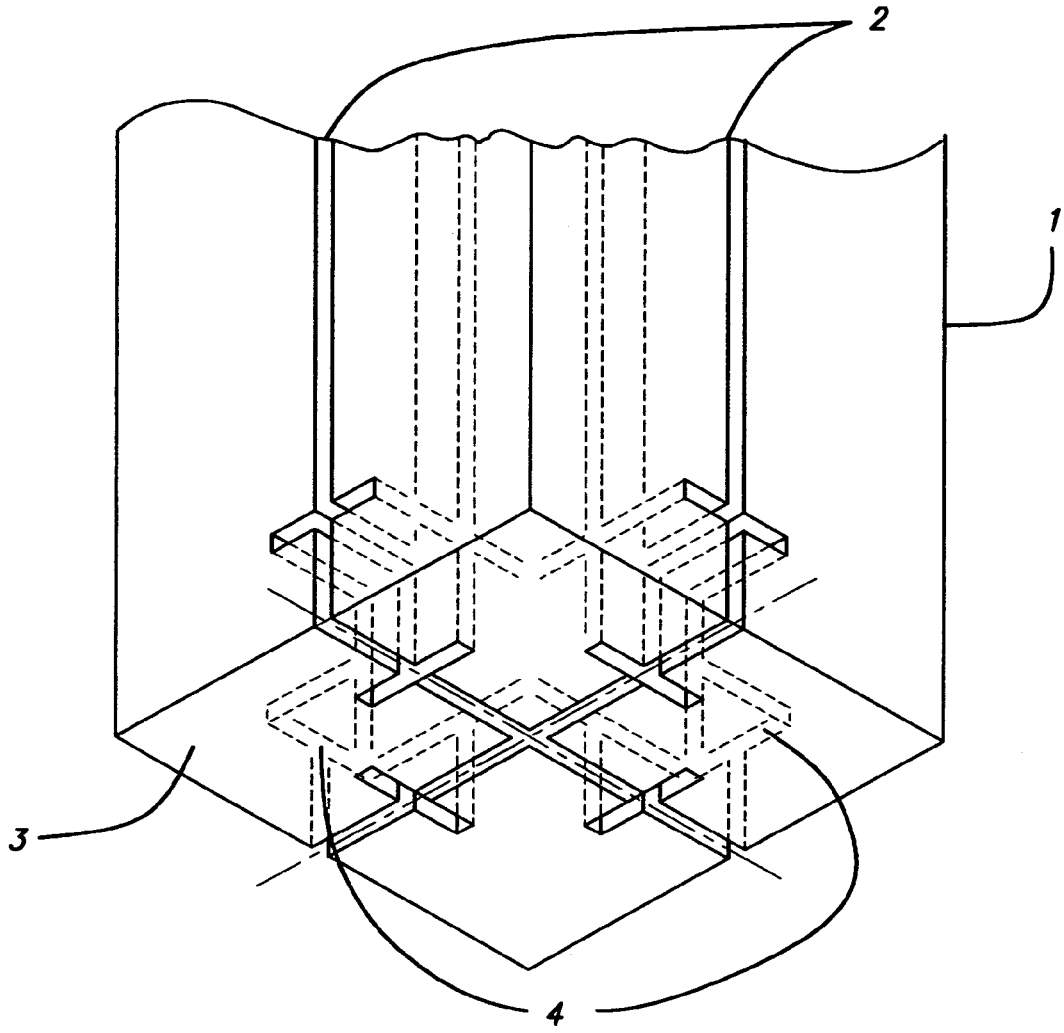
FIG. 2 shows an X-ray-like sectional view for the detailed illustration of the undercut grooves in the region of an end face of a universal structural element.

As shown in FIG. 1 and FIG. 2, a universal structural element 1 (1.1; 1.2; 1.3) in the form of a profile body having a substantially square cross-section comprises on all longitudinal sides undercut longitudinal grooves 2 (2.1 to 2.8) which are connected on the end sides 3 (3.1; 3.2) by means of intersecting undercut grooves 4 (4.1; 4.2) having an identical cross-section.

The corner formation, as illustrated by way of example in FIG. 1, of a three-dimensional structure, which is produced from universal structural elements 1 in the form of profile bodies, is achieved in that two universal elements 1.1 and 1.3, which are disposed in a horizontal, manner in the direction of the wall, are connected together in a non-positive and positive manner by way of undercut grooves 4 in the end sides 3 by means of double-T-shaped connectors 5 (5.1; 5.2) by way of an undercut longitudinal groove 2 of a vertically disposed universal structural element 1.2. Depending upon specific requirements, the connectors 5 can consist of metal, plastics or fibre-reinforced synthetic materials or also of wood materials.

Figure 3:
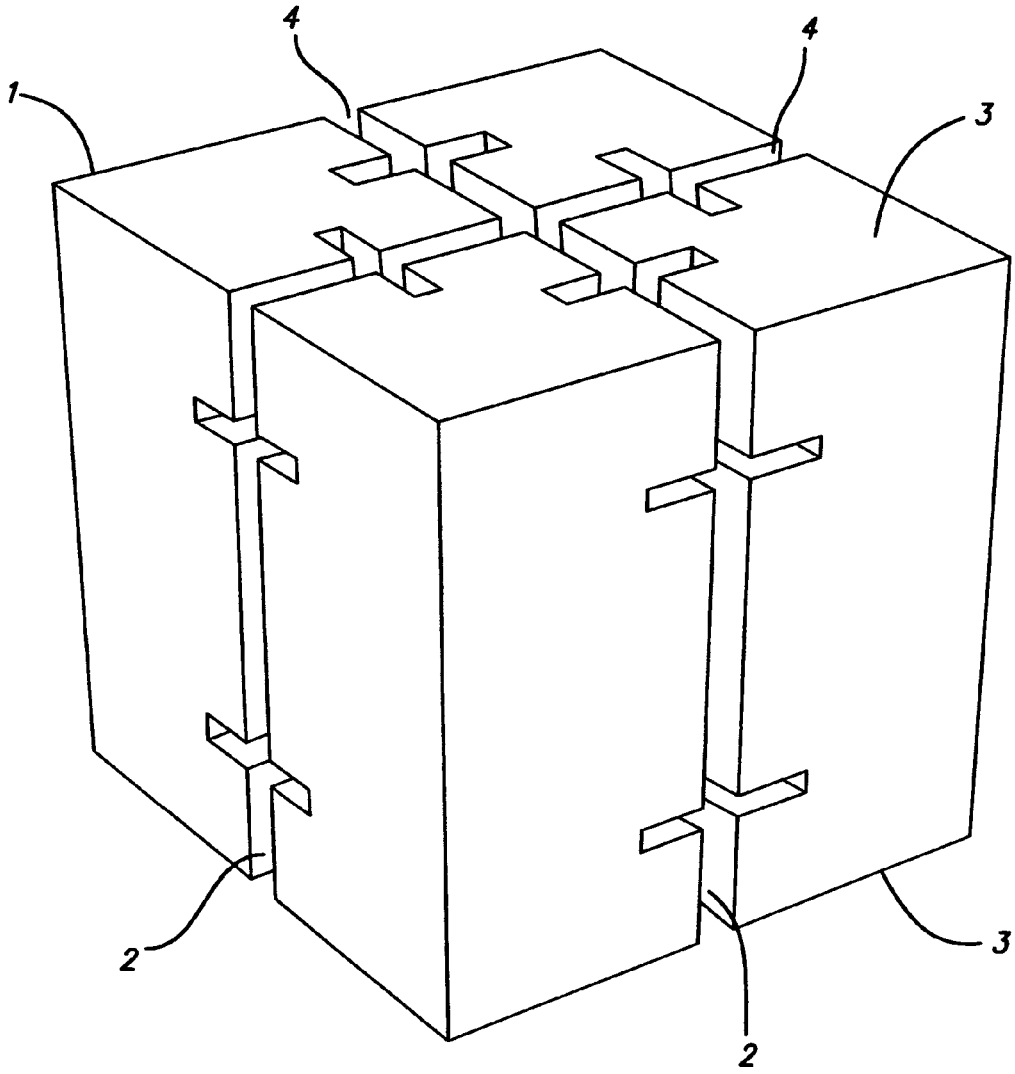
FIG. 3 shows a view of a universal structural element as a block.

The longitudinal extension of the vertically disposed universal structural element 1.2 corresponds to the height of the structure which is to be produced, wherein said structure can be composed of several universal structural elements 1 in modular dimensions, which structural elements are connected together in a non-positive and positive manner by means of connectors 5 by way of the undercut grooves 4 in their abutting end sides 3. The length of the horizontally disposed universal elements 1.1 and 1.3 preferably corresponds to a modular dimension that is allocated to standardized closure elements for construction orifices such as doors or windows. The value of the modular dimension can be further subdivided, so that a universal structural element 1 is provided in form of a block as shown in FIG. 3, which block comprises undercut longitudinal grooves 2, which are likewise connected by undercut grooves 4 in the end sides 3. As shown by way of example in FIG. 4 in the form of blocks, the universal structural elements 1 are connected together by means of connectors 5 that are inserted into the undercut longitudinal grooves 2. In principle, the similar universal structural elements 1 that are disposed adjacent to each other or also one on top of the other are connected in this way by connectors 5 in a non-positive and positive manner. The disassembly process is thus performed in the most convenient manner by pulling the connectors 5 out of the undercut longitudinal grooves 2. The connectors 5 and also the universal structural elements 1 can be reused for different structures or the same structure for the reconstruction thereof.

Figure 4:
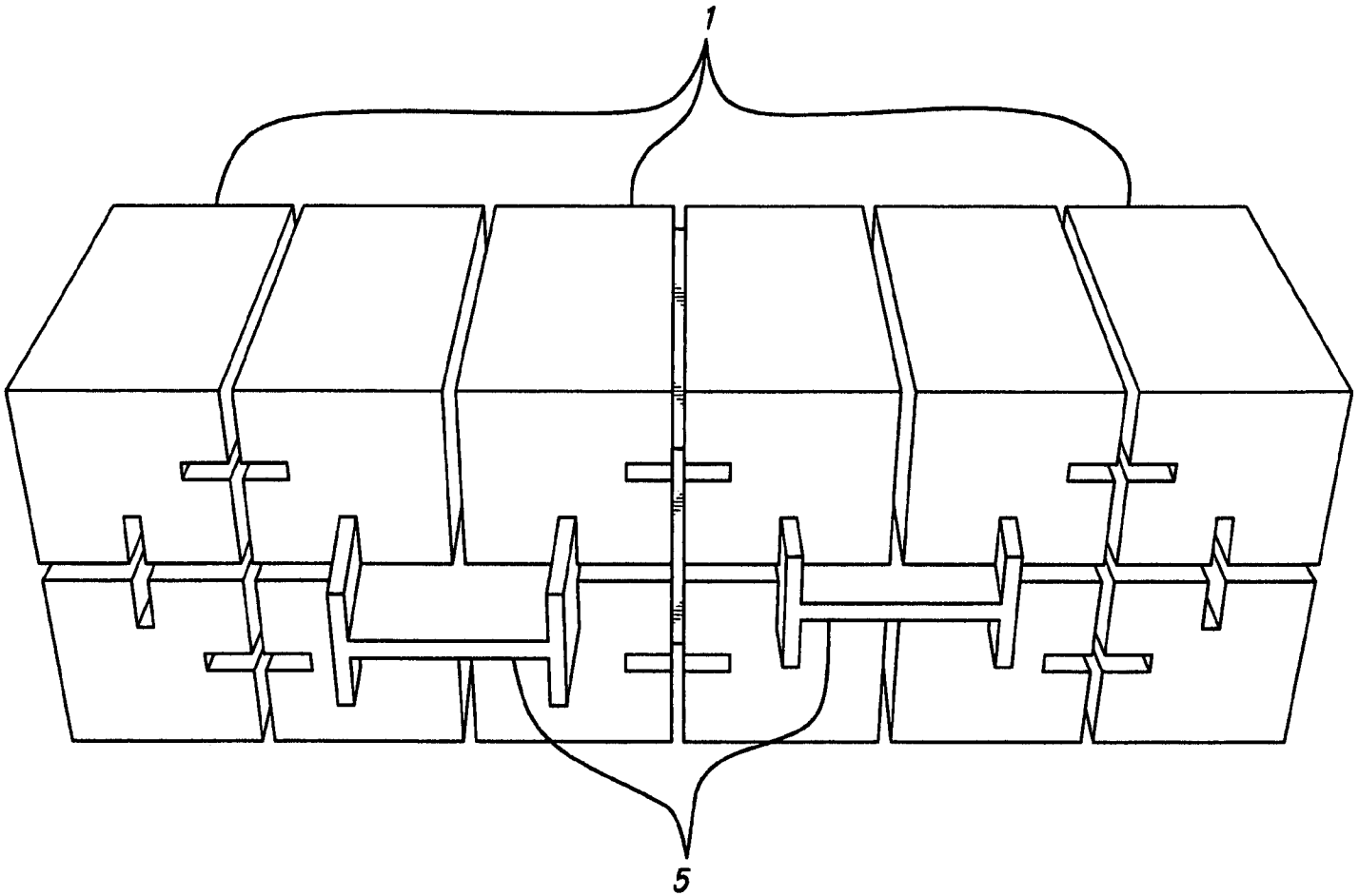
FIG. 4 shows an illustration of the connection of universal structural elements together.
Figure 5:
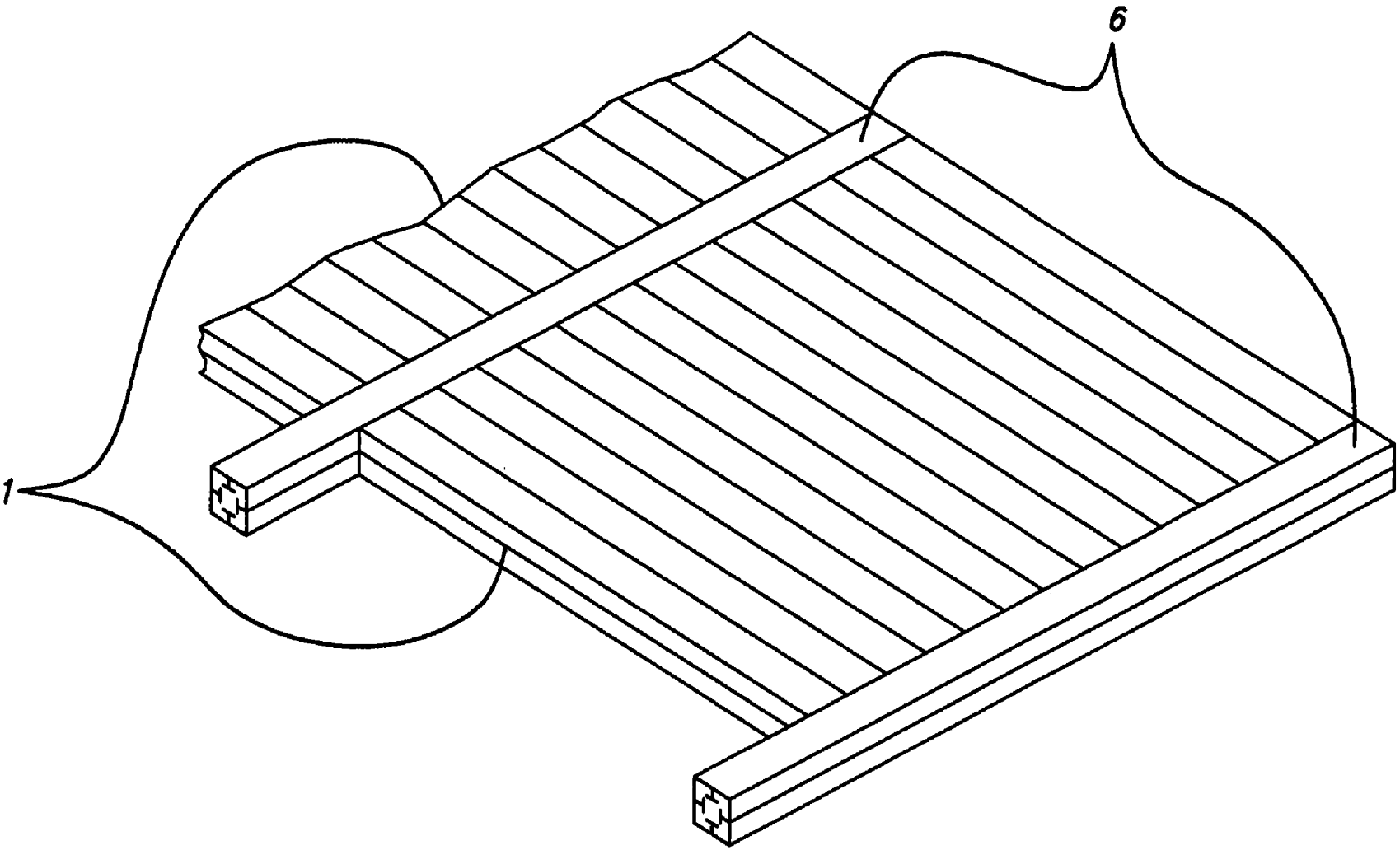
FIG. 5 shows an arrangement of universal structural elements for the purpose of forming a building ceiling or wall.

FIG. 5 illustrates an example of the arrangement of universal structural elements 1 as a wall or floor or ceiling element which is assembled in a block-board type of construction, wherein the universal structural elements 1 which function as beams 6 are connected in a non-positive and positive manner, similar to the means illustrated in FIGS. 3 and 4 and their arrangement, by way of the undercut longitudinal grooves 2 by means of connectors 5 by way of undercut grooves 4 in the end sides 3 of the other mutually connected universal structural elements 1 which are disposed at a right angle thereto and in each case lie opposite one another in parallel. It is equally possible to combine structures produced in this or a similar manner with other construction parts, such as insulating courses and/or cladding arrangements, as it is to conveniently disassemble and modify or extend the arrangement of universal structural elements 1 that are assembled to form a structure. Given low requirements upon the static properties of a structure consisting of universal structural elements 1, it is also possible to achieve a merely positive connection by means of a flat profile in the undercut longitudinal grooves 2 of universal structural elements 1 which are disposed in parallel.

Figure 6:
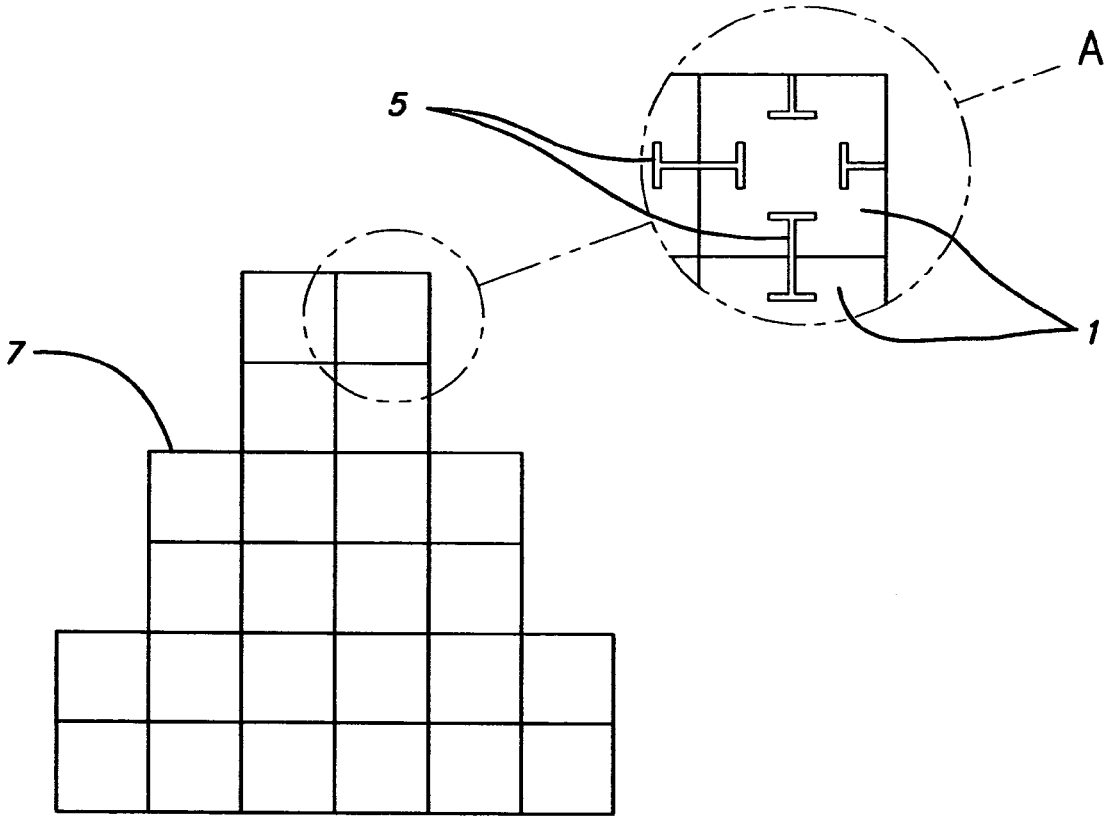
FIG. 6 shows an arrangement of structural elements for a foundation.

Further examples of possible applications of the universal structural element 1 in the field of construction include inter alias the formation of a foundation 7, as shown in FIG. 6, by means of a non-positive and positive interconnection of universal structural elements 1 by means of connectors 5, as shown in the detail A.

Figure 7:
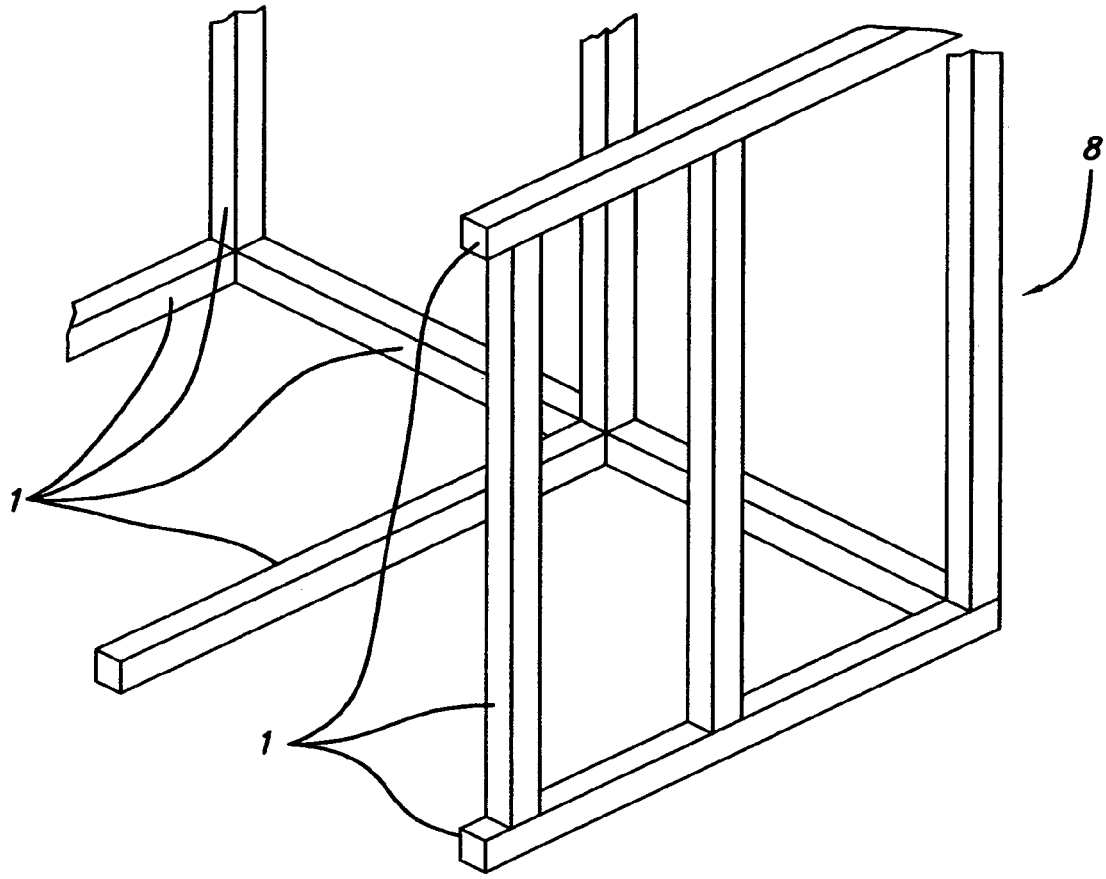
FIG. 7 shows an arrangement of structural elements as a framework.

It is likewise possible to arrange universal structural elements 1 for the purpose of forming a framework 8 as shown in FIG. 7. In this case, the vertically disposed universal structural elements 1 are connected in a non-positive and positive manner, similar to the means and their geometric design as shown in FIG. 3 and FIG. 4, by way of the undercut grooves 4 in the end sides 3 by means of connectors 5, of which the length corresponds at a maximum to the width of the end side 3, and the undercut longitudinal grooves 2 of the horizontally disposed universal structural elements 1. The structures that are formed from the universal structural elements 1 can be closed by panels that are received in each case in the undercut longitudinal grooves 2.

In a similar manner, it is also possible to produce structural parts and structural elements, for example, for furniture or vehicles.

LIST OF REFERENCE NUMERALS USED

1 universal structural element
2 undercut longitudinal groove
3 end side
4 undercut groove
5 connector
6 beam
7 foundation
8 framework
A detail

What is claimed is:

1. A universal structural element (1) comprising:
(a) a body having a plurality of longitudinal sides and at least two end sides (3);
(b) an undercut longitudinal groove (2) on at least one longitudinal side, each said undercut longitudinal groove (2) extending from a first end side (3) to a second end side (3);
(c) intersecting undercut grooves (4) in at least one of said at least two end sides (3), said intersecting undercut grooves (4) extending between longitudinal sides (2);
(d) said undercut longitudinal grooves (2) and said intersecting undercut grooves (4) having substantially consistent cross-sections; and
(e) said intersecting undercut grooves (4) connected to said undercut longitudinal grooves (2).

2. The universal structural element (1) according to claim 1 wherein the cross-section of said undercut longitudinal grooves (2) and said intersecting undercut grooves (4) is selected from the group consisting of:
(a) T-shaped;
(b) semi-circular with a cross-piece;
(c) circular with a cross-piece; and
(d) wedge-shaped.

3. The universal structural element (1) according to claim 1 wherein said body has a substantially rectangular cross-section.

4. The universal structural element (1) according to claim 1 wherein said body is constructed from a material selected from the group consisting of:
(a) synthetic materials;
(b) metal; and
(c) natural materials.

5. The universal structural element (1) according to claim 1 wherein said undercut longitudinal grooves (2) are suitable to receive a reinforcement member.

6. The universal structural element (1) according to claim 1 wherein a plurality of universal structural elements (1) are operatively connected together by means of connectors (5) by way of their undercut longitudinal grooves (2) and/or their intersecting undercut grooves (4) so as to form structural units up to complex constructions.

7. The universal structural element (1) according to claim 6, wherein said connectors (5) are made from a material selected from the group consisting of:
(a) metal;
(b) synthetic material; and
(c) natural material.

8. A universal structural element (1) comprising:
(a) a body having at least one longitudinal side and at least two end sides (3);
(b) an undercut longitudinal groove (2) in at least one of said at least one longitudinal side, each said undercut longitudinal groove (2) extending from a first end side (3) to a second end side (3);
(c) intersecting undercut grooves (4) in at least one of said at least two end sides (3), said intersecting undercut grooves (4) extending between longitudinal sides (2); and
(d) said intersecting undercut grooves (4) intersecting with said undercut longitudinal groove (2).

9. The universal structural element (1) of claim 8, wherein said intersecting undercut grooves (4) comprise a partial length that corresponds to the depth of said intersecting undercut groove (4).

10. The universal structural element (1) of claim 8, wherein each intersecting undercut groove (4) has an open first groove end and an open second groove end, said open first groove end intersecting with a first at least one longitudinal side and said open second groove end intersecting with a second at least one longitudinal side.

11. The universal structural element (1) of claim 8 wherein the cross-section of said undercut longitudinal groove (2) and said intersecting undercut grooves (4) is selected from the group consisting of:
(a) T-shaped;
(b) semi-circular with a cross-piece;
(c) circular with a cross-piece; and
(d) wedge-shaped.

12. The universal structural element (1) of claim 8 wherein a plurality of universal structural elements (1) are operatively connected together by means of connectors (5) by way of at least one undercut longitudinal groove (2) and/or said intersecting undercut grooves (4) so as to form structural units up to complex constructions.

13. A universal structural element system comprising:

(a) a plurality of universal structural elements, each universal structural element comprising:

(i) a body having at least one longitudinal side and at least two end sides (3);

(II) an undercut groove (2) in at least one of said longitudinal sides, said undercut groove (2) extending from a first end side (3) to a second end side (3);

(iii) intersecting undercut grooves (4) in at least one of said end sides (3), said undercut grooves (4) extending from a first longitudinal side to a second longitudinal side; and (IV) said undercut grooves (2), (4) preferably have the same cross-section;

(b) at least one double sided connector (5), each side of said at least one double sided connector (5) suitable for interconnecting with said undercut grooves (2), (4);

(c) a first of said plurality of universal structural elements (1) operatively connected to a second of said plurality of universal structural elements (1) by means of said at least one double sided connector (5), a first side of said at least one double sided connector (5) interconnecting with an undercut groove (2), (4) in said first of said plurality of universal structural elements (1) and a second side of said at least one double sided connector (5) interconnecting with an undercut groove (2), (4) in said second of said plurality of universal structural elements (1).

14. The universal structural element (1) according to claim 1 wherein each intersecting undercut groove (4) has an open first groove end and an open second groove end, said open first groove end intersecting with a first longitudinal side and said open second groove end intersecting with a second longitudinal side.

15. The universal structural element (1) according to claim 1 wherein each said undercut groove is a cut made below another cut so as to leave an overhang.

16. The universal structural element (1) according to claim 1 wherein said substantially consistent cross-sections are T-shaped.

17. The universal structural element (1) of claim 8 wherein each said undercut groove is a cut made below another cut so as to leave an overhang.

18. The universal structural element (1) of claim 8, said body having at least four longitudinal sides, wherein a first intersecting undercut groove (4) in a first end side (3) extends from a first longitudinal side to an opposite second longitudinal side with a substantially consistent cross-section and a second intersecting undercut groove (4) in said first end side (3) extends from a third longitudinal side to an opposite fourth longitudinal side with a substantially consistent cross-section.

19. The universal structural element (1) of claim 18 wherein said substantially consistent cross-sections are T-shaped.

20. The universal structural element system of claim 13 wherein each said undercut groove (2), (4) is a cut made below another cut so as to leave an overhang.

* * * * *

UNITED STATES PATENT AND TRADEMARK OFFICE

CERTIFICATE OF CORRECTION

PATENT NO. : 7,340,868 B2
APPLICATION NO. : 10/927923
DATED : March 11, 2008
INVENTOR(S) : Weber It is certified that error appears in the above-identified patent and that said Letters Patent is hereby corrected as shown below:

Title Page
Insert -- (30) Foreign Application Priority Data
November 24, 1999 (DE) ... 299 20 656.4 --

Column 2
Line 67, replace "Ceilings" with -- ceilings --.

Column 3
Line 6, replace "Wedge" with -- wedge --.

Column 3
Line 30, replace "alias" with -- alia --.

Column 5
Line 22, replace "alias" with -- alia --.

Signed and Sealed this

First Day of July, 2008

JON W. DUDAS
*Director of the United States Patent and Trademark Office*